US005509615A

United States Patent [19]

Ohtoko et al.

[11] Patent Number: 5,509,615

[45] Date of Patent: Apr. 23, 1996

[54] IRREGULAR PITCH GROOVED TRAVERSE DRUM HAVING SHIFTED YARD PATH TURNING POINTS

[75] Inventors: Naotsugu Ohtoko, Yao; Takeshi Ohno, Shiki, both of Japan

[73] Assignee: Kabushiki Kaisha Mino Seisakusho, Yao, Japan

[21] Appl. No.: 125,847

[22] Filed: Sep. 24, 1993

[30] Foreign Application Priority Data

Sep. 30, 1992 [JP] Japan ..... 4-260956

[51] Int. Cl.[6] ..... B65H 54/28

[52] U.S. Cl. ..... 242/43.2; 242/18 DD

[58] Field of Search ..... 242/18 DD, 43.2, 242/27, 31, 27.1

[56] References Cited

U.S. PATENT DOCUMENTS

| | | | |
|---|---|---|---|
| 5,044,571 | 9/1991 | Ohashi | 242/43.2 X |
| 5,143,313 | 9/1992 | Ohashi | 242/43.2 X |

FOREIGN PATENT DOCUMENTS

| | | | |
|---|---|---|---|
| 1219951 | 5/1960 | France | 242/43.2 |
| 3924946A1 | 2/1990 | Germany . | |
| 4010470A1 | 10/1991 | Germany . | |
| 63-218474 | 9/1988 | Japan . | |
| 3088676 | 4/1991 | Japan | 242/43.2 |
| 4-153164 | 5/1992 | Japan . | |
| 683508 | 11/1952 | United Kingdom | 242/43.2 |

*Primary Examiner*—William Stryjewski

*Attorney, Agent, or Firm*—Nikaido, Marmelstein, Murray & Oram

[57] ABSTRACT

A grooved traverse drum for winding yarn on to a bobbin comprises a yarn guide groove spirally formed in an external surface thereof and including inversely running forwarding and returning paths connected with each other at a pair of turning points situated at opposite ends of the drum, portions of the forwarding and returning paths immediately following the respective turning points having a greater lead angle so that the yarn being guided moves towards the center of the drum as quickly as it passes the turning points, thereby preventing the formation of stitch at end surfaces of a yarn package being produced.

12 Claims, 2 Drawing Sheets

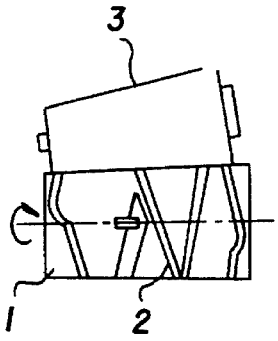
FIG. 1(A)
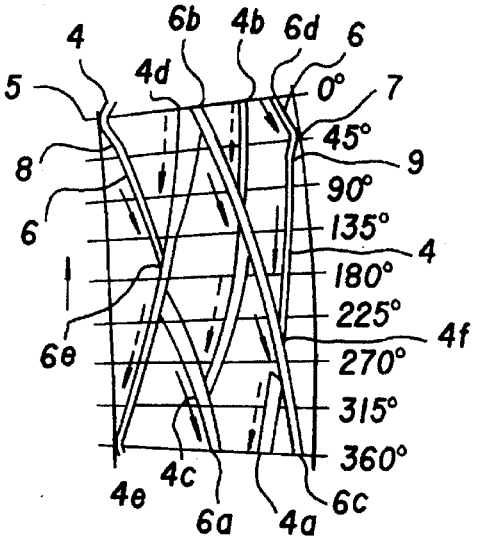
FIG. 1(B)
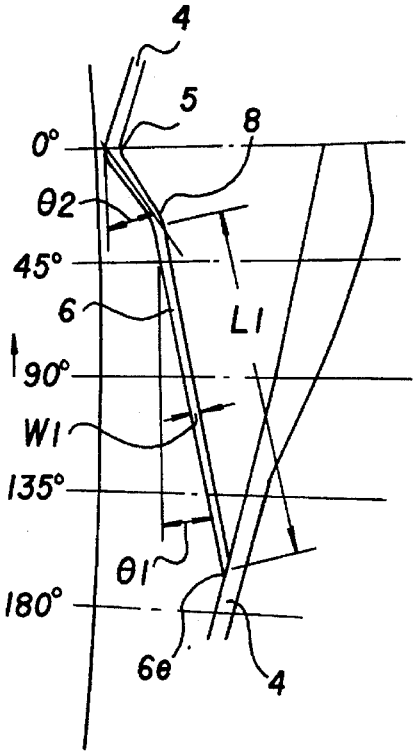
FIG. 1(C)
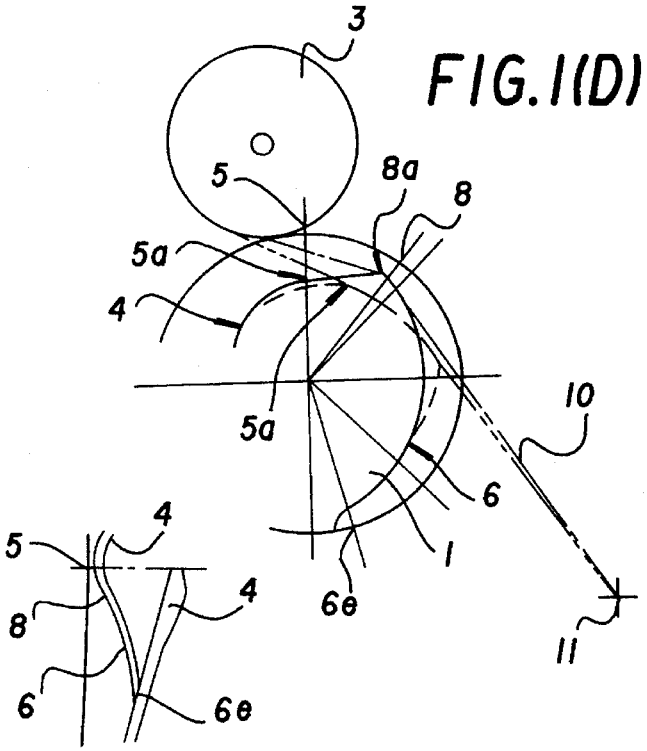
FIG. 1(D)
FIG. 1(E)

IRREGULAR PITCH GROOVED TRAVERSE DRUM HAVING SHIFTED YARD PATH TURNING POINTS

BACKGROUND OF THE INVENTION

1. Field of the Invention

The present invention relates to a grooved traverse drum for use with a yarn winder. Although the invention is also applicable to any type of the conventional drums, the novel drum according to the invention is particularly suited for use in combination with a super high-speed winder, and the drum as such will now be described by way of an example.

2. Prior Art

Normally, any of those conventional yarn winders used in most of spinning mills winds yarns at 1,000 through 1,200 meters per minute winding speed at most. However, recently, super high-speed winders have been introduced for use, which can actually wind yarns at more than 1,500 meters per minute of super high speed.

When winding yarns with a super-high-speed winder incorporating conventional grooved traverse drums at more than 1,500 meters per minute of winding speed, a variety of problems emerged. For example, passing yarns jumped out of grooves in specific portions of the drum, which resulted in the failed traversing operation. In particular, when diameter of the loaded package exceeded 250 mm, in many eases, an objectionable phenomenon called cob-webbing or "stitch" (as known in the art of winding) occurred at the end surfaces of the loaded package.

SUMMARY OF THE INVENTION

Therefore, an object of the invention is to provide a novel grooved traverse drum which can securely solve a variety of technical problems incidental to any of conventional grooved traverse drums and which operates with satisfactory traverse motion even-when winding each yarn at more than 1,500 meters per minute of super high speed, securely eliminating the occurrence of cob-webbing at the end surfaces of the loaded package even when winding yarns to form a package having a diameter of more than 250 mm.

To achieve the above object, the invention provides a grooved traverse drum for use with a yarn winder for winding an individual yarn, said drum having a forwarding path and a returning path thereof and formed in an external circumferential surface thereof and extending in the form of helicoidal groove in inverse directions and connected to each other at turning points at opposite ends thereof, so that as said drum rotates said yarn is traversely guided and is wound onto a bobbin rotating itself in contact with said drum, wherein said turning points of said forwarding groove and said returning groove are shifted from each other by 18° up to a maximum of 90° in the rotating direction of said drum in the direction of increasing the number of turns of said forwarding path, and wherein deflection points are respectively formed at predetermined positions right behind said turning points so that said forwarding path and said returning path deflect at the respective deflection points from directions in which said forwarding path and returning path turn at said turning points.

Furthermore, according to the invention, lead angles (θ1) and (θ2) of said returning path in the front and on the back of said deflection point on the part of said turning point of said returning path are so specified that the lead angle (θ1) is not greater than 20° and the lead angle (θ1) is less than the lead angle (θ2); depth of groove of said returning path is gradually shallow from said turning point of said returning path towards said deflection point where said returning path has the shallowest depth, said returning path being gradually deeper towards a first disconnected domain of said forwarding path., and being again shallow on the halfway until reaching the first disconnected domain of said forwarding path, a region of said returning path between said deflection point and said first disconnected domain of said forwarding path has a length not less than 30 mm and a width identical to or narrower than that of the shallowest part of said returning path adjacent to said deflection point, and wherein lead angles (θ3) and (θ4) of said forwarding path in the front and on the back of said deflection point on the part of said turning point of said forwarding path are so predetermined that the lead angle (θ3) is greater than the lead angle (θ4), depth of groove of said forwarding path being suddenly shallow from said turning point of said forwarding path towards said deflection point, thenceforth, said groove extending up to a first disconnected domain of said returning path without substantially varying depth, a region of said forwarding path between said deflection point and said first disconnected domain of said returning path has a length not less than said 30 mm and a width identical to or narrower than that of a portion adjacent to said deflection point at which sudden variation of depth is terminated.

Furthermore, according to the invention, region of said forwarding path between said turning point of said returning path and said first disconnected domain of said forwarding path is substantially convexed towards the center of said drum and has width identical to or wider than that of the shallowest part of said returning path at a position adjacent to said turning point of said returning path.

According to the invention, the turning point of the groove in the forwarding path and another turning point of the groove in the returning path are shifted by 18° up to a maximum of 90° in the rotating direction of the drum and in the direction of increasing the number of turns of the forwarding path. By virtue of this arrangement, lead angle of the forwarding path between the turning point of the returning path and the first disconnected domain of the returning path are contracted from conventionally available lead angles. This in turn reduces frictional resistance between individual yarns and a lateral surface of the groove, and therefore, even when the yarn winder winds each yarn at more than 1,500 meters per minute of super high speed, there is no probability of the yarn jumping out of the groove. Furthermore, since the deflection points are formed right behind the respective turning points so that the paths deflect from the direction in which they turn at the turning points, the passing yarn curves itself at the deflection points, increasing tensile force acting on the passing yarn at the moment of being wound onto an objective bobbin immediately after leaving a position close to the turning points, thus securely preventing the formation of cob-webbing at the end surface of the package being produced.

Furthermore, according to the invention, lead angles (θ1) and (θ2) in the front and on the back of the deflection point on the part of the turning point of the returning path are so defined that the lead angle (θ1) is a maximum of 20° and the lead angle (θ1) is not greater than the lead angle (θ2). By virtue of this arrangement, the passing yarn curves itself at the deflection point, resulting in an increased tensile force on the passing yarn at the moment of being wound onto an objective bobbin immediately after leaving a position close to the turning points. The depth of groove of the returning path is as follows: the groove is gradually sallowed from the turning point of the returning path towards the deflection point, where it is shallowest; the groove is gradually deeper from the deflection point towards the first disconnected domain of the forwarding path; the groove is again shallow on the halfway until being connected to the first disconnected domain of the forwarding path. By virtue of this arrangement of depth of groove, tensile force on the passing yarn is promoted at the moment of being wound onto an edge surface on the releasing side of the yarn package. Furthermore, the groove has a minimum of 30 mm of length between the deflection point and the first disconnected domain of the forwarding path, and yet, the groove has width identical to or narrower than that of the shallowest part of the groove in the vicinity of the deflection point. This in turn restricts and minimizes oscillation of the passing yarn to the left and to the right inside of the groove caused by variation of tensile force on the yarn. In consequence, owing to multiplied effect of structural advantages mentioned above, when the yarn winder winds an individual yarn at more than 1,500 meters per minute of super high speed and subsequently magnifies variation of tensile force on the passing yarn, there is no probability of cob-webbing being formed at the end surface on the releasing side of the package loaded with more than 250 mm-diameter of the yarn.

Furthermore, the invention provides lead angles (θ3) and (θ4) in the front and on the back of the inflection point on the part of the turning point of the forwarding path are so defined that the lead angle (θ3) is smaller than the lead angle (θ4). This in turn causes the passing yarn to bend itself at the deflection point, resulting in an increased tensile force on the yarn at the moment of being wound onto an edge surface opposite to the releasing side of the package immediately after leaving the turning point of the forwarding path. Furthermore, depth of groove of the forwarding path is suddenly shollowed from the turning point of the forwarding path towards the deflection point, where such sudden variation of the depth is terminated, and thenceforth, the groove extends up to the first disconnected domain of the returning path without substantially varying the depth. As a result, tensile force on the passing yarn is strengthened at the moment of being wound onto an edge surface opposite to the releasing side of the package after leaving a position adjacent to the turning point of the forwarding path. The groove has a minimum of 30 mm of length between the deflection point and the first disconnected domain of the returning path, and yet, the groove has width identical to or narrower than that of the groove adjacent to a position at which sudden variation of the depth of the groove close to the inflection point is terminated. This in turn restricts and minimizes oscillation of the yarn to the left and to the right inside of the groove caused by variation of tensile force on the passing yarn. As a result, owing to multiplied effect of those structural advantages mentioned above, even when the yarn winder winds an individual yarn at more than 1,500 meters per minute of super high speed and subsequently magnifies variation of tensile force on the yarn, there is no probability of cob-webbing being formed at the edge surface opposite to the releasing side of the package loaded with more than 250 mm-diameter of the yarn.

Furthermore, according to the invention, the forwarding path between the turning point of the returning path and the first disconnected domain of the forwarding path substantially convexed towards the center of the drum, and yet, the groove has width identical to or wider than that of the shallowest groove close to the turning point of the returning path. As a result, this arrangement in turn restricts and minimizes oscillation of the passing yarn to the left and to the right in the groove of the forwarding path caused by variation of tensile force on the yarn, thus effectively preventing the formation of cob-webbing at the edge surface on the releasing side of the package.

BRIEF DESCRIPTION OF THE DRAWINGS

FIG. 1A is a plan of the grooved traverse drum according to the invention;

FIG. 1B is a development of grooves in the drum;

FIG. 1C is an enlarged view of the drum surface adjacent to the turning point of the returning path;

FIG. 1D is a cross-sectional view of the drum adjacent to the turning point of the returning path;

FIG. 1E shows a modification of the groove shape of the forwarding path right behind the turning point of the returning path;

DESCRIPTION OF THE PREFERRED EMBODIMENTS

Figure 2B:
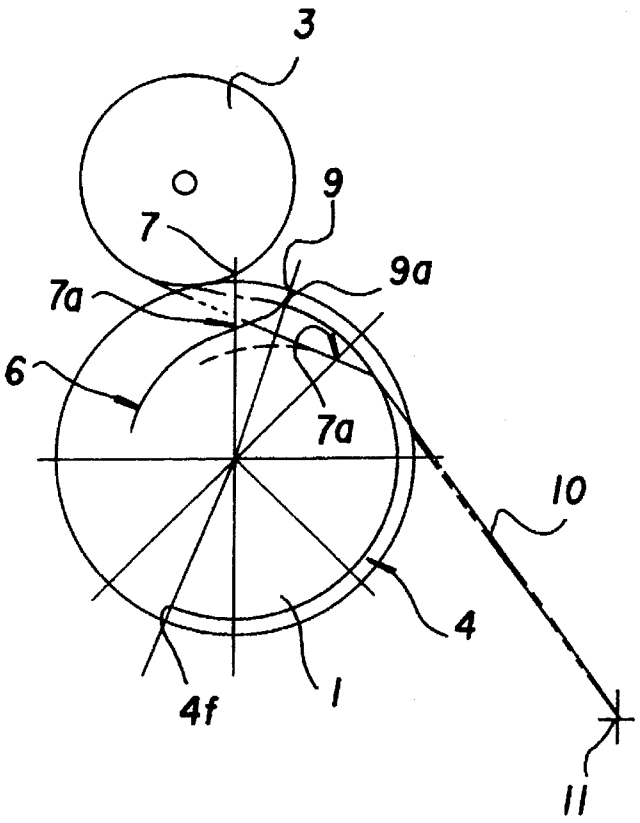
FIG. 2B is a cross-sectional view of the drum adjacent to the turning point of the forwarding path.

FIG. 1A is a plan of the grooved traverse drum embodying the invention. The reference numeral 1 designates the grooved traverse drum as an embodiment of the invention. The reference numeral 2 designates helicoidal, or spiral grooves formed in external circumferential surface of the drum 1. The reference numeral 3 designates a package.

FIG. 1B shows a development of the grooves 2 formed in the external circumferential surface of the drum 1 according to the invention. Turning point 5 of a returning path 4 is shifted by 45° in the direction of the rotation of the drum 1 from turning polar 7 of a forwarding path 6. The direction of shift corresponds to the direction of increasing the number of turns of the forwarding path 6. When the returning path 4 has large number of turns, the amount of shift comes up to a maximum of 90°. On the other hand, when the returning path 4 has a small number of turns, the amount of shift comes approximately up to 45°. In either of these cases, the minimum amount of shift is predetermined to be 18°. Amount of shift can optionally be selected within the range specified above. Even when the turning points 5 and 7 at opposite ends of the drum 1 are 180° apart from each other, the turning point 5 of the returning path 4 is shifted in the direction of increasing the number of turns of the forwarding path 6 by a specific amount corresponding to any of the angles specified above. The returning path 4 shown in FIG. 1B is substantially a groove that guides an individual yarn from the turning point 7 of the forwarding path 6 up to the turning point 5 of the returning path 4 via routes **4*a*, 4*b*, 4*c*, 4*d*, and 4*e* as shown by dotted lines with arrow. Likewise, as shown in FIG. 1B, the forwarding path 6 is substantially a groove that guides an individual yarn from the turning point 5 of the returning path 4 to the turning point 7 of the forwarding path 6 via routes 6*a*, 6*b*, 6*c*, and 6*d* as shown by solid lines with arrow. As known in the art, where the path 6 crosses the path 4, a crossover, interrupted portion 6*e*** of the groove occurs. In this application, this is named the first disconnected domain.

If the amount of shift ever exceeds the maximum of the specified range, then it will expand lead angle of the region of the returning path 4 adjacent to the turning point 5. When the winding speed of the winder exceeds 1,500 meters per minute, the passing yarn will jump out of the groove in that region to result in the failure of proper traverse motion of the delivered yarn. On the other hand, if the amount of shift were below the minimum of the specified range, then, the lead angle of the forwarding path 6 from the turning point 5 of the returning path 4 to the first disconnected domain 6*e* of the forwarding path 6 cannot properly be shifted. As a result, occurrence of faulty traverse motion cannot be decreased without practical improvement.

Deflection points 8 and 9 are respectively formed right behind the turning point 5 of the returning path 4 and the turning point 7 of the forwarding path 6. The returning path 4 and the forwarding path 6 deflect at the deflection points 8 and 9, respectively, from the direction in which the paths 4 and 5 turn at the respective turning points 5 and 7.

FIG. 1C is an enlarged view of the drum surface close to the turning point 5 of the returning path 4 shown in FIG. 1B. According to the invention, lead angles (θ1) and (θ2) in the front and on the back of the deflection point 8 right behind the turning point 5 of the returning path 4 are so predetermined that the lead angle. (θ1) is a maximum of 20° and less than (θ2). When the lead angle (θ1) is below 20°, even when the winding speed of the winder exceeds 1,500 meters per minute of super high speed, there is little probability of causing the passing yarn to jump out of the forwarding path 6 in the region of the lead angle (θ1) to result in the failure of proper traverse motion of the delivered yarn. Since the lead angle (θ1) is less than the lead angle (θ2), after passing through the forwarding path 6 corresponding to the lead angle (θ2), the yarn bends itself at the moment of being wound onto an edge surface of the package. As a result, an increased frictional resistance is provided by a lateral surface of groove of the forwarding path 6 thus effectively promoting tensile force acting on the yarn while being wound onto the package.

FIG. 1D is an enlarged sectional view explanatory of variable depth of the returning path 4 adjacent to the deflection point 8 right behind the turning point 5. The returning path is gradually shallow from the turning point 5 towards the deflection point 8. The returning path is shallowest in the vicinity of the deflection point 8, and thenceforth, is gradually deeper in the direction of the first disconnected domain 6*e* of the forwarding path 6. The returning path is again shallow on the halfway until being connected to the first disconnected domain 6*e* of the forwarding path 6. By effect of varying the depth of groove of the returning path as described, the delivered yarn 10 is wound onto edge surface of the package 3 via the shallow groove 8*a* in the vicinity of the deflection point 8 by way of travelling itself through a distance longer than the case of travelling itself from traverse fulcrum 11 to the edge surface of the package 3 via the groove bottom 5*a* at the turning point 5 of the returning path 4 before eventually being wound onto the edge surface of the package 3. As a result, travelling speed of the yarn 10 is accelerated to cause tensile force on the yarn 10 to be strengthened when being wound onto the edge surface of the package 3.

As shown in FIG. 1C, the invention provides a minimum of 30 mm of length L1 between the deflection point 8 and the first disconnected domain 6*e* of the forwarding path 6, where the width W1 is identical to or narrower than the width of the shallowest groove region in the vicinity of the deflection point 8. By virtue of this arrangement, the passing yarn 10 is freed from oscillating itself to the left and to the right in the groove of the forwarding path 6 between the deflection point 8 and the first disconnected domain 6*e* of the forwarding path 6. If the length L1 were less than 30 mm, then, no practical effect can be achieved. The width W1 preferably ranges from 1.5 mm to a maximum of 4.0 mm. Less than 1.5 mm of the width W1 involves much difficulty from the manufacturing standpoint. On the other hand, more than 4.0 mm of the width W1 can hardly cause oscillation of the yarn 10 to be eliminated. As shown in FIG. 1E, if the groove of the forwarding path 6 between the deflection point 8 and the first disconnected domain 6*e* of the forwarding path 6 is substantially convex towards the center of the drum 1, then, the groove width W1 can be expanded to be wider than the width specified above. Even in this case, the yarn 10 can be freed from oscillating itself to the left and to the right in the groove.

Therefore, owing to multiplied effect of the above-referred structural requisites on the part of the turning point 5 of the returning path 4, even when the yarn winder winds each yarn at more than 1,500 meters per minute of super high speed, there is little probability of cob-webbing being formed at the edge surface on the releasing side of the package 3 loaded with yarn corresponding to more than 250 mm of diameter.

Figure 2A:
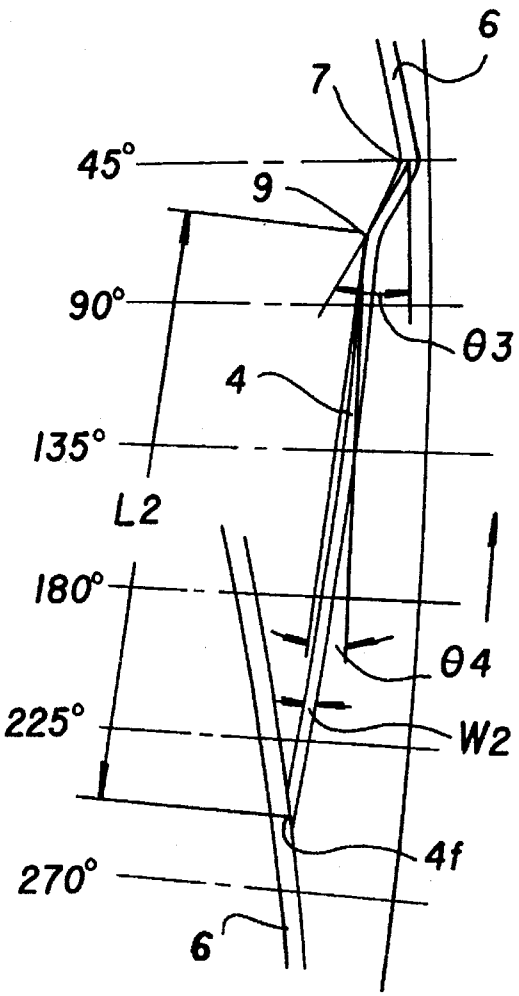
FIG. 2A is an enlarged view of the drum surface adjacent to the turning point of the forwarding path.

As shown in FIG. 2A, the invention provides lead angles (θ3) and (θ4) in the front and on the back of the deflection point 9 on the part of the turning point 7 of the forwarding path 6 with the relationship in which the lead angle (θ3) is greater than the lead angle (θ4), where the lead angle (θ3) is predetermined to be a maximum of 20°. By virtue of this arrangement, even when the yarn winder winds each yarn at more than 1,500 meters per minute of super high speed, there is no fear of the yarn 10 jumping out of the returning path 4 at the domain of the lead angle (θ4) followed by failure of proper traverse motion. Since the lead angle (θ3) is greater than the lead angle (θ4), after passing through the returning path 4 corresponding to the domain of the lead angle (θ4), the yarn 10 bends itself when being wound onto an edge surface opposite to the releasing side of the package 3. As a result, an increased frictional resistance is provided by a lateral surface of groove of the returning path 4 the tensile force acting on the yarn 10 when being wound onto the package 3 is increased. Therefore, there is no fear of the yarn 10 falling to properly traverse.

Furthermore, as shown in FIG. 2B, the groove of the returning path 4 is suddenly shallowed from the turning point 7 of the forwarding path 6 towards the deflection point 9, and yet, sudden variation of the groove depth is terminated in the vicinity of the deflection point 9, and thenceforth, the groove is extended to the first disconnected domain 4*f* of the returning path 4 without substantially varying the groove depth. Thus, the yarn 10 is wound onto the edge surface of the package 3 adjacent to an end thereof via shallow groove 9*a* in the vicinity of the deflection point 9 by way of travelling itself through a distance longer than the case of travelling itself from traverse fulcrum 11 to the edge surface of the package 3 via groove bottom 7*a* at the turning point 7 of the forwarding path 6. This in turn accelerates the travelling speed of the yarn 10 to strengthen tensile force on the yarn itself when being wound onto the edge surface of the package 3, thus securely preventing the formation of cob-webbing.

Furthermore, as shown in FIG. 2A, the invention provides a minimum of 30 mm of length L2 between the deflection point 9 and the first disconnected domain 4*f* of the returning path 4, where the groove width W2 is identical to or narrower than the width of the groove adjacent to a position at which sudden variation of the groove depth in the vicinity of the deflection point 9 is terminated. As a result, the passing yarn 10 is freed from oscillating itself to the left and to the right in the groove of the returning path 4 between the deflection point 9 and the first disconnected domain 4*f* of the returning path 4.

Owing to multiplied effect of the above-referred structural requisites on the part of the turning point 7 of the returning path 6, even when the yarn winder winds each yarn at more than 1,500 meters per minute of super high speed, there is little probability of failing to impart proper traverse motion to the delivered yarn on the edge surface opposite to the releasing side of the package 3 loaded with yarn corresponding to 250 mm of diameter. If the groove portion having width W2 were provided with less than 30 mm of own length L2, and yet, if the winder winds the delivered yarn at more than 1,500 meters per minute of super high speed, then, the delivered yarn cannot properly traverse at the edge surface opposite to the releasing side of the package 3 loaded with yarn corresponding to 250 mm of diameter, thus failing to achieve the predetermined effect. The width W2 preferably ranges between 1.5 mm and 4.0 mm. If the width W2 were less than 1.5 mm, then, production process involves much difficulty. On the other hand, more than 4.0 mm of width W2 also fails to achieve the predetermined effect. In the event that the returning path 4 between the turning point 7 of the forwarding path 6 and the first disconnected domain 4*f* of the returning path 4 is convexed towards the edge surface of the drum 1, the groove width W2 can be arranged to be identical to or wider than that of the shallowest groove portion in the vicity of the turning point 7 of the forwarding path 6.

The cone-shaped grooved traverse drum has been described and shown which has 2.125 turns of the forwarding path 6 and 2.875 turns of the returning path 4. However, the scope of the invention is not solely limited to the above embodiment. For example, the number of turns of the forwarding path 6 may be greater than the conventional number of turns (1, 1.5, 2, 2.5, 3) by 0.05 through 0.25 turn while the number of turns of the returning path 4 may be less than the conventional number of turns (2, 2.5, 3, 3.5, 4, 4.5, 5) by the number increased for the forwarding path 4, and yet, it is readily understood that any appropriate combination of the number of turns of the forwarding path 6 and the returning path 4 may be adopted as required. Although the cone-shape package 3 has been shown and described, the invention is also applicable to parallel cheese.

As has been described so far, according to the invention, the turning point of the returning path is shifted from the turning point of the forwarding path; immediately after the turning point of the returning path at which the forwarding path starts, the lead the forwarding path deflects from the direction in which the forwarding path has turned; and the depth, width, and the length of groove of the forwarding path adjacent to the deflection of the forwarding path are varied as described previously. By virtue of the above arrangement, the drum of the invention can securely prevent improper traverse motion at the edge surface on the releasing side of the package. In the same way, immediately after the turning point of the forwarding path at which the returning path starts, the returning path deflects from the direction in which the returning path has turned; the depth, width, and the length of groove of the returning path adjacent to the deflection of the returning path are varied as described previously. By virtue of this arrangement, the drum of the invention can securely prevent faulty traverse motion from occurring at an edge surface opposite to the releasing side of the package 3. In particular, faulty traverse motion is obviated even when the yarn winder winds the delivered yarn at more than 1,500 meters per minute of super high speed, and yet, the novel drum can securely prevent proper traverse motion from being spoiled, with no cob-webbing being formed at an edge surface of the package loaded with yarn aggregating more than 250 mm of diameter.

What is claimed is:

1. A grooved traverse drum for use with a yarn winder for winding an individual yarn, said drum having a forwarding path and a returning path thereof formed in an external circumferential surface thereof and extending in the form of helicoidal groove in inverse directions and connected to each other at turning points at opposite ends of said drum, so that as said drum rotates said yarn is traversely guided and is wound onto a bobbin rotating itself in contact with said drum, wherein said turning points of said forwarding groove and said returning groove are shifted from each other by from 18° up to a maximum of 90° in the rotating direction of said drum in the direction of increasing the number of turns of said forwarding path, and wherein deflection points are respectively formed at predetermined positions further in the rotating direction beyond said turning points so that said yarn being guided in said forwarding path and said returning path is deflected at the respective deflection points from directions in which said forwarding path and returning path turn at said turning points.

2. The grooved traverse drum as defined in claim 1 wherein said region of said forwarding path between said turning point of said returning path and a first disconnected domain of said forwarding path is substantially convexed towards a center of said drum and has a width identical to or wider than a width of a shallowest part of said returning path at a position adjacent to said turning point of said returning path.

3. A grooved traverse drum as defined in claim 1, wherein first and second lead angles (θ1) and (θ2) of said forwarding path defined by the angle of the forwarding path relative to the rotating direction before and after said deflection point following said turning point of said returning path in the rotating direction are so specified that the first lead angle (θ 1) is not greater than 20° and the first lead angle (θ1) is less than the second lead angle (θ2).

4. A grooved traverse drum as defined in claim 1, wherein a depth of groove of said returning path from said external circumferential surface of said drum is gradually shallower from said turning point of said returning path towards said deflection point where said returning path has the shallowest depth, said returning path being gradually deeper towards a first disconnected domain of said forwarding path, and being again shallow until reaching the first disconnected domain of said forwarding path.

5. A grooved traverse drum as defined in claim 4, wherein a region of said returning path between said deflection point and said first disconnected domain of said forwarding path has a length not less than 30 mm.

6. A grooved traverse drum as defined in claim 5, wherein said region has a width identical to or narrower than that of the shallowest part of said returning path adjacent to said deflection point.

7. A grooved traverse drum as defined in claim 1, wherein third and fourth lead angles (θ3) and (θ4) of said returning path defined by the angle of the returning path relative to the rotating direction before and after said turning point of said forwarding path in the rotating direction are so predetermined that the third lead angle (θ3) is greater than the fourth lead angle (θ4).

8. A grooved traverse drum as defined in claim 1, wherein a depth of groove of said forwarding path being suddenly shallow from said turning point of said forwarding path towards said deflection point, thenceforth, said groove extending up to a first disconnected domain of said returning path without substantially varying depth.

9. A grooved traverse drum as defined in claim 8, wherein a region of said forwarding path between said deflection point and said first disconnected domain of said returning path has a length not less than said 30 mm.

10. A grooved traverse drum as defined in claim 9, wherein said region has a width identical to or narrower than that of a portion adjacent to said deflection point at which sudden variation of depth is terminated.

11. A grooved traverse drum for use with a yarn winder for winding an individual yarn, said drum having a forwarding path and a returning path thereof formed in an external circumferential surface thereof and extending in the form of helicoidal groove in inverse directions and connected to each other at turning points at opposite ends of said drum, so that as said drum rotates said yarn is traversely guided and is wound onto a bobbin rotating itself in contact with said drum, wherein said turning points of said forwarding groove and said returning groove are shifted from each other by from 18° up to a maximum of 90° in the rotating direction of said drum in the direction of increasing the number of turns of said forwarding path, wherein deflection points are respectively formed at predetermined positions further in the rotating direction beyond said turning points so that said yarn being guided in said forwarding path and said returning path is deflected at the respective deflection points from directions in which said forwarding path and returning path turn at said turning points, wherein first and second lead angles ($\theta 1$) and ($\theta 2$) of said forwarding path defined by the angle of the forwarding path relative to the rotating direction before and after said deflection point following said turning point of said returning path in the rotating direction are so specified that the first lead angle ($\theta 1$) is not greater than 20° and the first lead angle ($\theta 1$) is less than the second lead angle ($\theta 2$); a depth of groove of said returning path from said external circumferential surface of said drum is gradually shallower from said turning point of said returning path towards said deflection point where said returning path has the shallowest depth, said returning path being gradually deeper towards a first disconnected domain of said forwarding path, and being again shallow until reaching the first disconnected domain of said forwarding path, a region of said returning path between said deflection point and said first disconnected domain of said forwarding path has a length not less than 30 mm and a width identical to or narrower than that of the shallowest part of said returning path adjacent to said deflection point, and wherein third and fourth lead angles ($\theta 3$) and ($\theta 4$) of said returning path defined by the angle of the returning path relative to the rotating direction before and after said turning point of said forwarding path in the rotating direction are so predetermined that the third lead angle ($\theta 3$) is greater than the fourth lead angle ($\theta 4$), a depth of groove of said forwarding path being suddenly shallow from said turning point of said forwarding path towards said deflection point, thenceforth, said groove extending up to a first disconnected domain of said returning path without substantially varying depth, a region of said forwarding path between said deflection point and said first disconnected domain of said returning path has a length not less than said 30 mm and a width identical to or narrower than that of a portion adjacent to said deflection point at which sudden variation of depth is terminated.

12. The grooved traverse drum as defined in claim 11, wherein said region of said forwarding path between said turning point of said returning path and said first disconnected domain of said forwarding path is substantially convexed towards the center of said drum and has width identical to or wider than that of the shallowest part of said returning path at a position adjacent to said turning point of said returning path.

* * * * *